US009724927B2

(12) United States Patent
Donning et al.

(10) Patent No.: US 9,724,927 B2
(45) **Date of Patent: *Aug. 8, 2017**

(54) MULTI-PART FLUID FLOW STRUCTURE

(71) Applicant: HEWLETT-PACKARD DEVELOPMENT COMPANY, L.P., Houston, TX (US)

(72) Inventors: Mark C. Donning, Corvallis, OR (US); Carey E. Yliniemi, Monmouth, OR (US); Robert S. Wickwire, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 22 days.

This patent is subject to a terminal disclaimer.

(21) Appl. No.: 15/217,390

(22) Filed: Jul. 22, 2016

(65) Prior Publication Data

US 2016/0332444 A1 Nov. 17, 2016

Related U.S. Application Data

(63) Continuation of application No. 14/648,071, filed as application No. PCT/US2012/067539 on Dec. 3, 2012, now Pat. No. 9,440,441.

(51) Int. Cl.

| | |
|---|---|
| ***B41J 2/175*** | (2006.01) |
| ***B41J 2/14*** | (2006.01) |
| ***B41J 2/16*** | (2006.01) |

(52) U.S. Cl.

CPC ..... *B41J 2/175* (2013.01); *B41J 2/14024* (2013.01); *B41J 2/1433* (2013.01); *B41J 2/1603* (2013.01); *B41J 2/1623* (2013.01); *B41J 2/17513* (2013.01); *B41J 2/17523* (2013.01); *B41J 2202/14* (2013.01); *B41J 2202/19* (2013.01); *B41J 2202/20* (2013.01)

(58) Field of Classification Search

CPC .... B41J 2/175; B41J 2/17523; B41J 2/17513; B41J 2/1623; B41J 2202/14

See application file for complete search history.

(56) References Cited

U.S. PATENT DOCUMENTS

| | | | | |
|---|---|---|---|---|
| 6,193,362 | B1 | 2/2001 | Nakata et al. | |
| 6,290,340 | B1 | 9/2001 | Kitahara et al. | |
| 6,751,581 | B1 | 6/2004 | Ondrus et al. | |
| 7,311,272 | B2 | 12/2007 | Ito | |
| 7,401,897 | B2 * | 7/2008 | Ito | B41J 2/14209 347/20 |
| 7,442,317 | B2 | 10/2008 | Silverbrook | |

(Continued)

FOREIGN PATENT DOCUMENTS

| | | |
|---|---|---|
| CN | 1149535 | 5/1997 |
| CN | 1324302 | 11/2001 |

(Continued)

*Primary Examiner* — Geoffrey Mruk

(74) *Attorney, Agent, or Firm* — HP Inc.—Patent Department

(57) ABSTRACT

In one example, a multi-part flow structure with multiple flow passages includes a first part sandwiched between a second part and a third part, the parts joined together with adhesive along bonding surfaces surrounding the flow passages where each of the bonding surfaces on one part is symmetrical to and diverges from a corresponding one of the bonding surfaces on another part.

13 Claims, 10 Drawing Sheets

(56) References Cited

U.S. PATENT DOCUMENTS

| | | | |
|---|---|---|---|
| 7,527,347 | B2 | 5/2009 | Mukai |
| 7,798,613 | B2 | 9/2010 | Silverbrook |
| 7,926,916 | B2 | 4/2011 | Schmidt et al. |
| 9,440,441 | B2 * | 9/2016 | Donning ..... B41J 2/14024 |
| 2006/0221139 | A1 | 10/2006 | Mukai |
| 2006/0283974 | A1 | 12/2006 | Eguchi et al. |
| 2007/0279453 | A1 | 12/2007 | DeKegelaer et al. |
| 2010/0134561 | A1 | 6/2010 | Sugahara |

FOREIGN PATENT DOCUMENTS

| | | |
|---|---|---|
| CN | 1568259 | 1/2005 |
| CN | 1623787 | 6/2005 |
| CN | 1880079 | 12/2006 |
| CN | 102673152 | 9/2012 |
| EP | 0495663 | 7/1992 |

* cited by examiner

MULTI-PART FLUID FLOW STRUCTURE

CROSS REFERENCE TO RELATED APPLICATIONS

This is a continuation of application Ser. No. 14/648,071 filed May 28, 2015, which is itself a 35 U.S.C. 371 national stage filing of international application serial no. PCT/U.S. 2012/067539 filed Dec. 3, 2012.

BACKGROUND

Some inkjet printhead assemblies include several parts joined together with adhesives. Passages formed in the parts provide pathways for ink to flow from the ink reservoir to the printhead.

DRAWINGS

The same part numbers designate the same or similar parts throughout the figures.

DESCRIPTION

Air defects in the adhesive joints surrounding ink flow passages in multi-part printhead assemblies can adversely affect the quality and performance of the printhead assembly. Air defects in this type of joint exist as shallow pockets, partial bubbles or voids in the adhesive at the interface between the adhesive and the surface of the parts. Air defects in adhesive joints along the ink flow path can cause persistent color mixing in cases where the defects create a pathway between neighboring ink passages, and failed printer start-ups and early printhead de-priming in cases where the defects form an air path from the ink passages to the atmosphere. Air defects may also reduce joint strength by decreasing the surface area between the adhesive and the parts, and shorten joint life by creating more and shorter paths for ink to move into and attack the adhesive.

A new multi-part ink flow structure has been developed for an inkjet printhead assembly to reduce air defects in the adhesive joint(s) between parts. In one example of the new flow structure, the opening to each flow conduit transitions along a curve from a smaller interior part of the opening to a larger exterior part of the opening that forms at least part of the bonding surface. The curved bonding surfaces on each part are symmetrical across the joint and substantially free of discontinuities that might impede or trap air in the flow of adhesive. As described in detail below, the new flow structure interrupts or eliminates the primary mechanisms that cause air defects in the adhesive joint, and thus reduces the presence of air defects and their adverse effects on the quality and performance of the printhead assembly.

Although examples of the new flow structure will be described with reference to an inkjet printhead assembly with detachable ink containers, examples are not limited to such printhead assemblies or to inkjet printers or even inkjet printing. Examples of the new flow structure might also be implemented in other types of printhead assemblies, in ink cartridges with an integral printhead, and in other types of fluid flow devices. The examples shown in the figures and described below, therefore, illustrate but do not limit the invention, which is defined in the Claims following this Description.

As used in this document, a "printhead" means that part of an inkjet printer or other inkjet type dispenser that dispenses liquid from one or more openings, for example as drops or streams.

Figure 1:
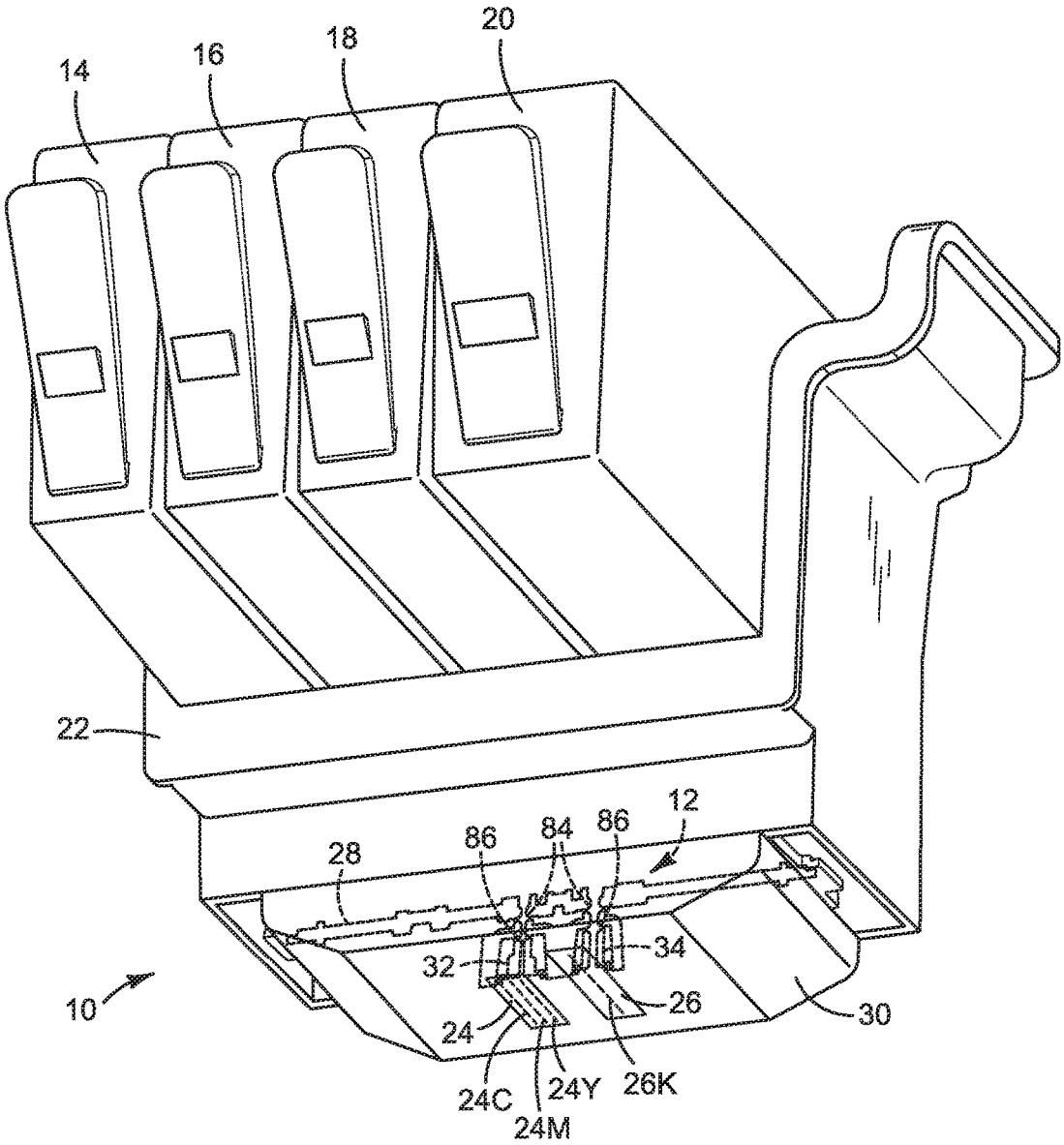
FIGS. 1 and 2 illustrate a printhead assembly implementing one example of a new multi-part fluid flow structure.
Figure 2:
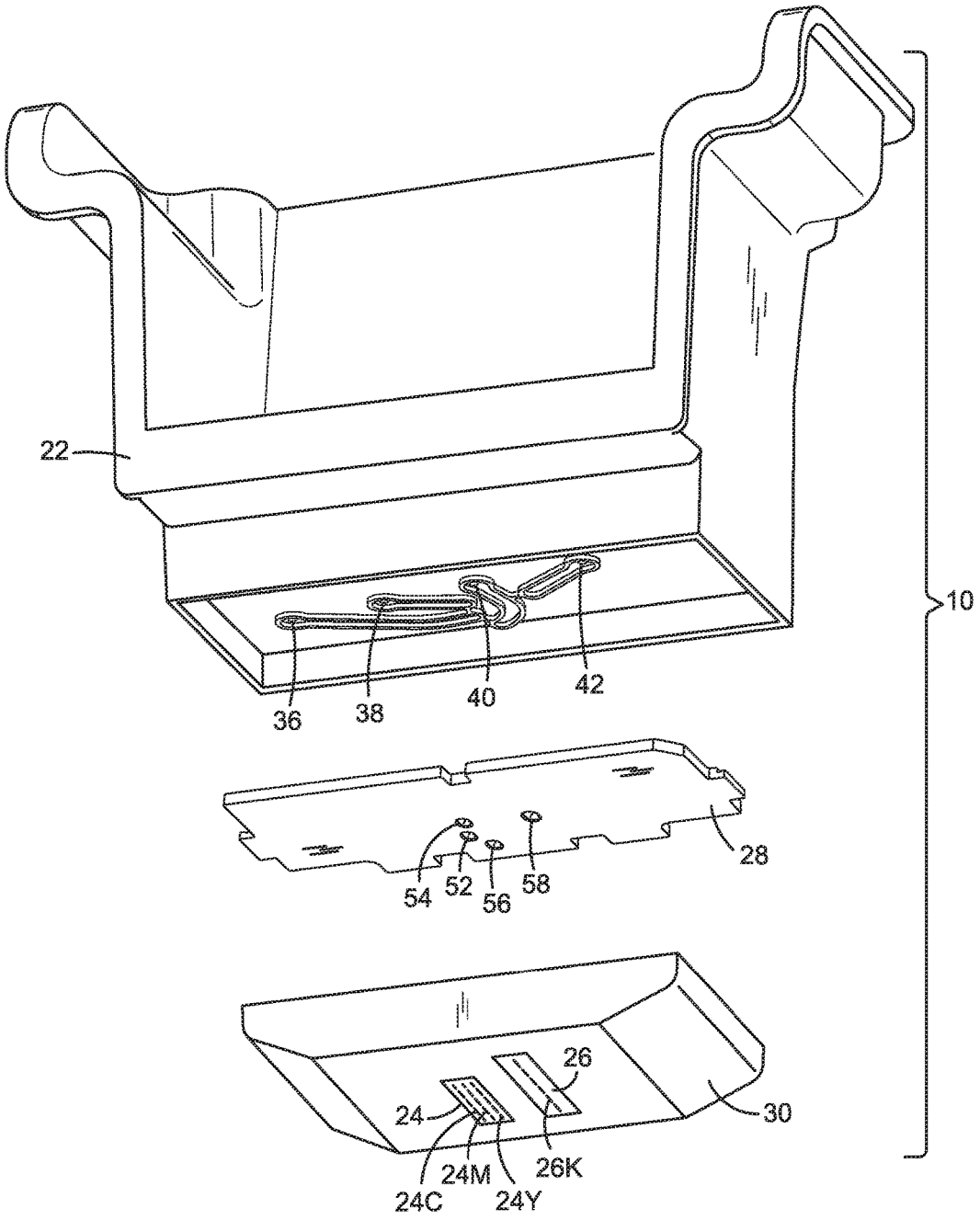

FIGS. 1 and 2 illustrate a printhead assembly 10 implementing one example of a new multi-part fluid flow structure 12. As shown in FIG. 1, printhead assembly 10 holds detachable ink containers 14, 16, 18, 20 that each contain a different color ink, for example, cyan (C), magenta (M), yellow (Y), and black (K) ink. Printhead assembly 10 may carry fewer or more ink containers or containers supplying colors other than those noted above. Referring now to both FIGS. 1 and 2, printhead assembly 10 includes a holder 22 for holding ink containers 14-20, an ink flow structure 12, and printheads 24 and 26. Portions of the components of ink flow structure 12 are outlined in hidden lines in FIG. 1, and only the manifold 28 part of structure 12 is shown in FIG. 2. Ink flow structure 12 is described in detail below with reference to FIGS. 3-10.

In the example of a printhead assembly 10 shown in FIGS. 1 and 2, printhead 24 dispenses cyan, magenta, and yellow ink (as indicated by three columns of ejection orifices 24C, 24M, 24Y) and printhead 26 dispenses black ink (as indicated by a single column of ejection orifices 26K). Other suitable printhead configurations are possible. For example, a single printhead could be used to dispense all four inks or only one ink (black) for a monochrome printer, and each printhead may include more or fewer orifice columns.

Figure 3:
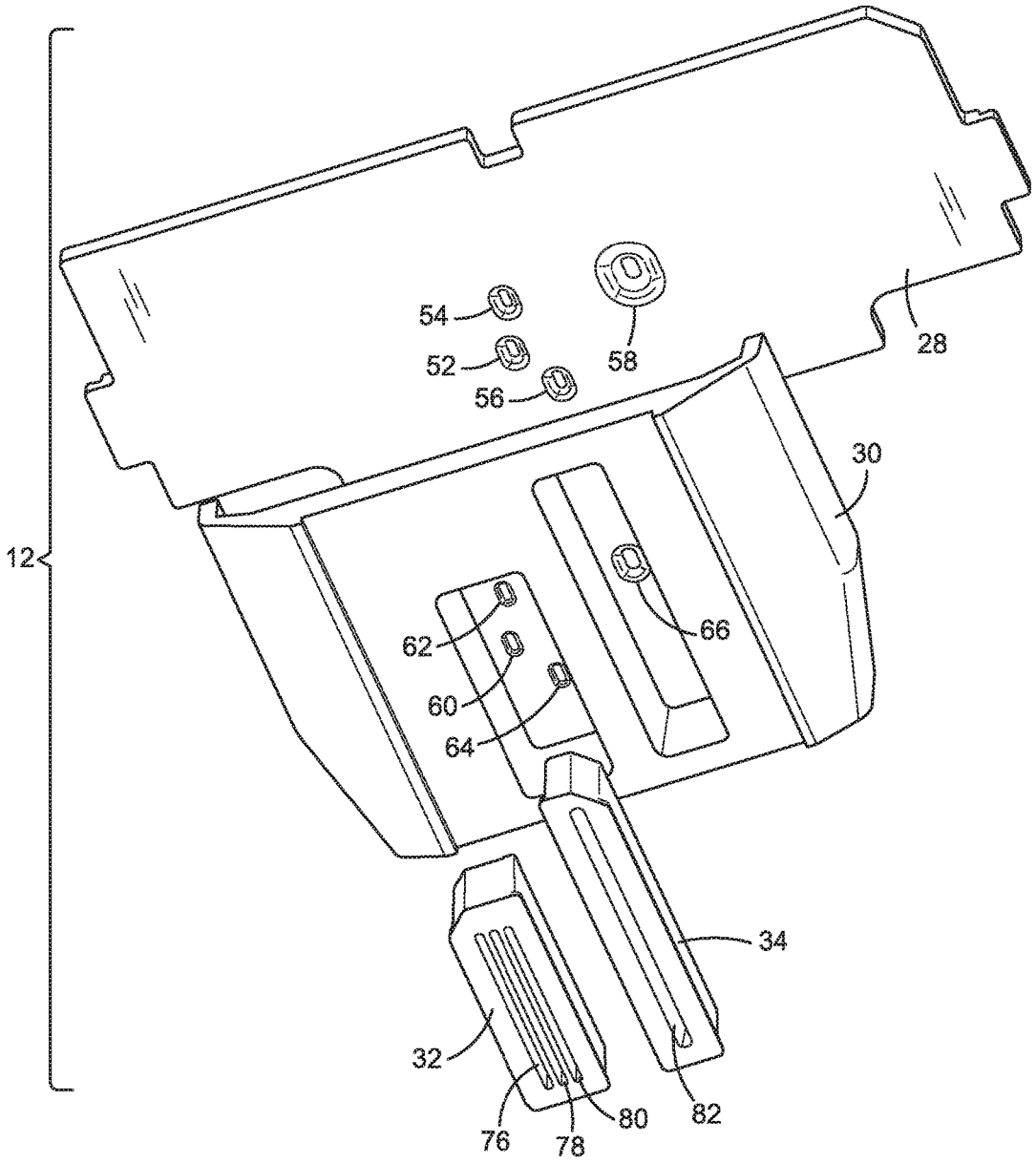
FIGS. 3 and 4 are exploded perspective views illustrating one example of a new multi-part fluid flow structure for a printhead assembly such as the one shown in FIGS. 1 and 2.
Figure 4:
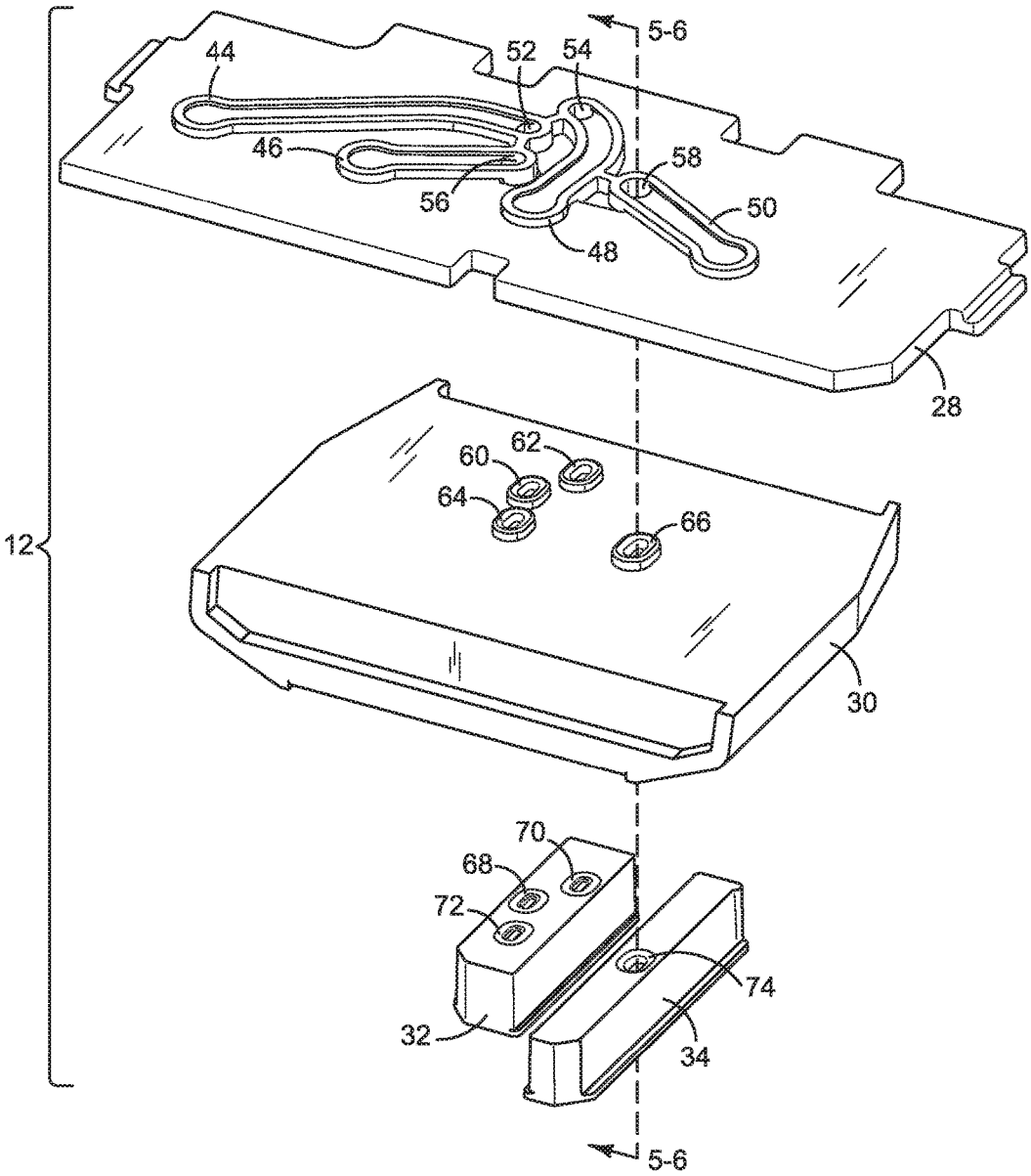

Referring now also to the exploded views of ink flow structure 12 shown in FIGS. 3 and 4, structure 12 is configured as an assembly of four parts—a manifold 28, a printhead mounting base 30, and ink feed plenums 32 and 34. Ink flows from containers 14-20 through inlets 36, 38, 40, 42 in holder 22 into channels 44, 46, 48, 50 in manifold 28 that carry ink to conduits 52, 54, 56, 58. Ink flows through conduits 52-58 in manifold 28 to conduits 60, 62, 64, 66 in base 30 and into conduits 68, 70, 72, 74 in feed plenums 32, 34. Each plenum 32, 34 feeds ink to a printhead 24, 26 through a series of expanding slots 76, 78, 80, 82. Other suitable configurations for ink flow structure 12 are possible. For example, feed plenums 32, 34 could be combined into a single part, feed plenum(s) and base 30 integrated into a single part, or in a monochrome printer a single feed plenum 34 may be used.

Figure 5:
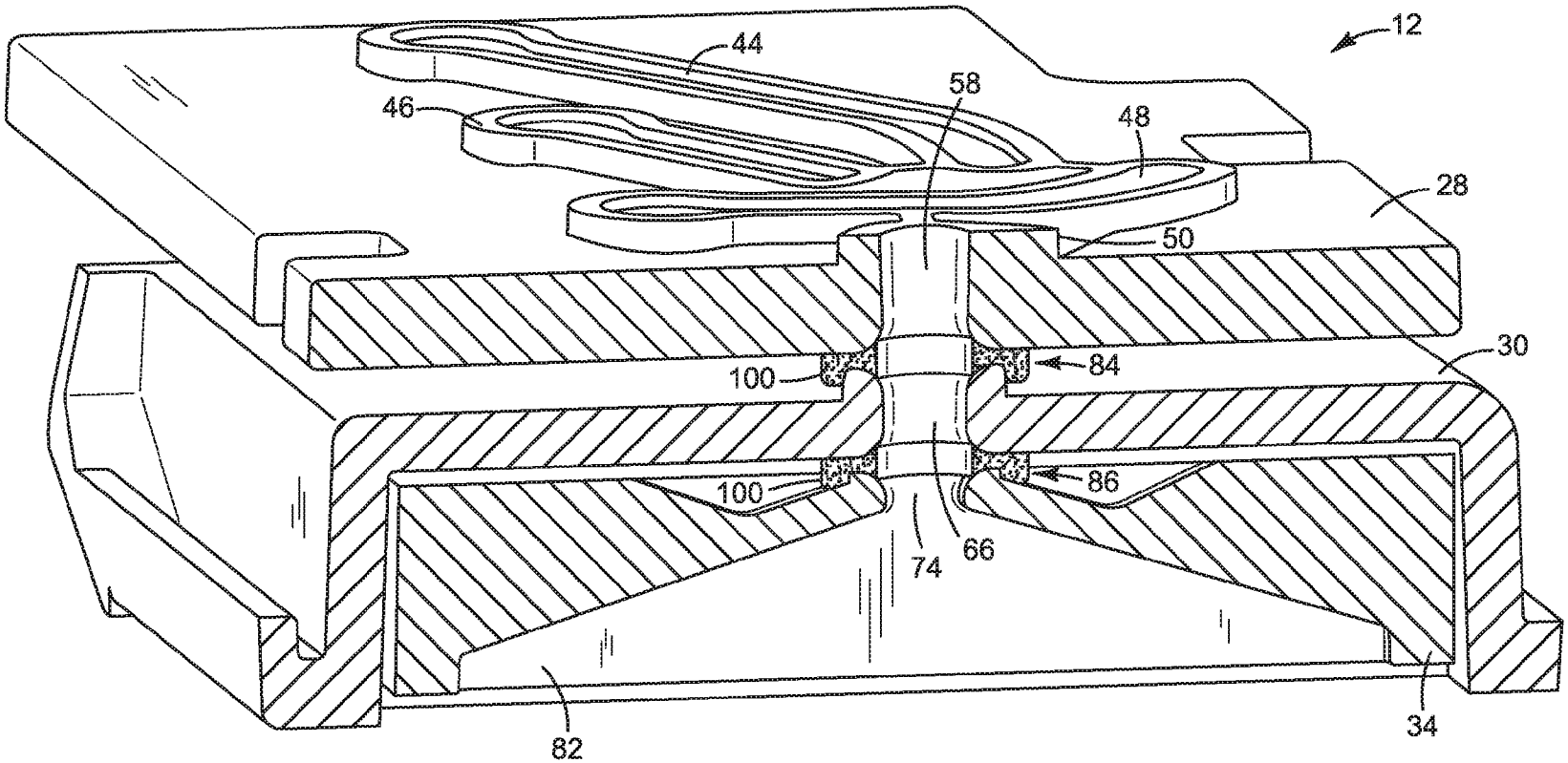
FIGS. 5 and 6 are perspective and elevation section views of the flow structure taken along the line 5, 6-5, 6 in FIG. 4. For clarity, the adhesive is omitted from FIG. 6.
Figure 6:
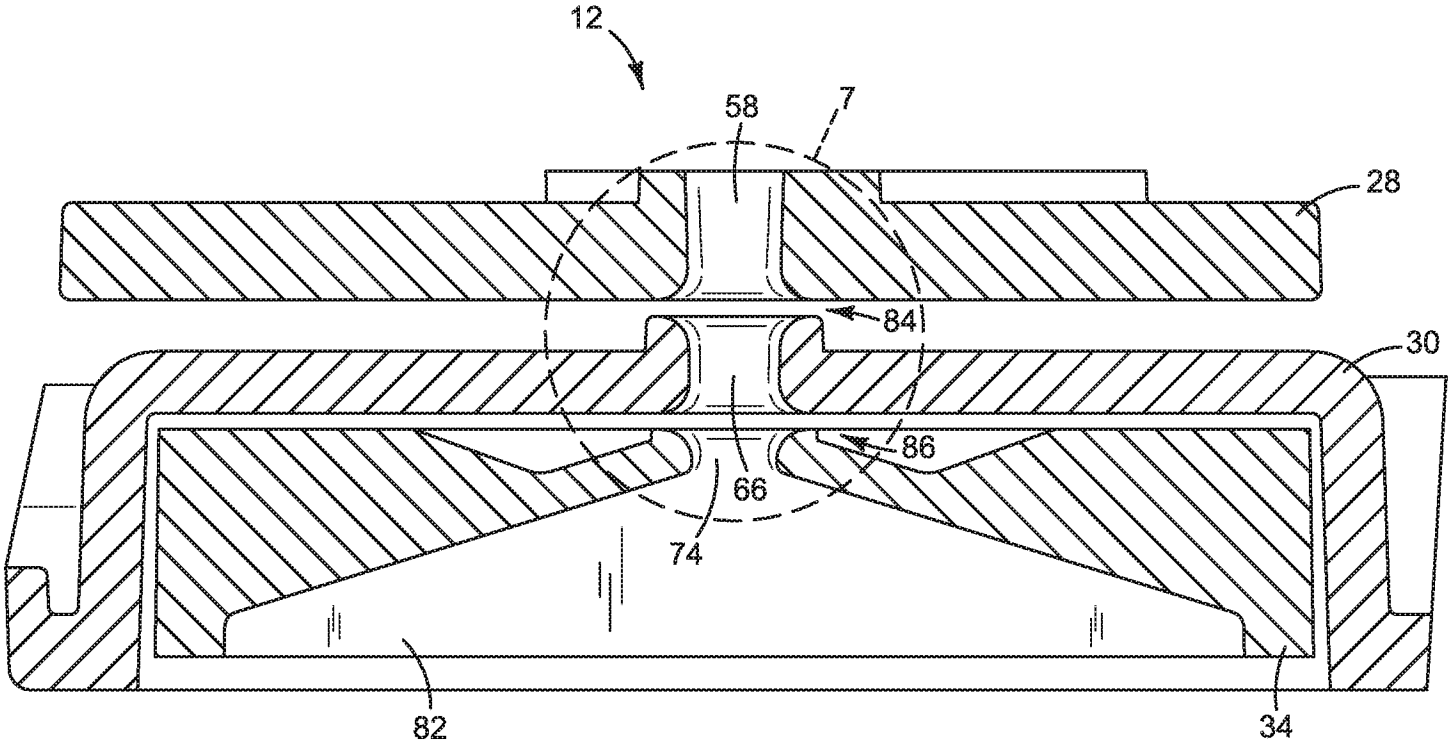
Figure 7:
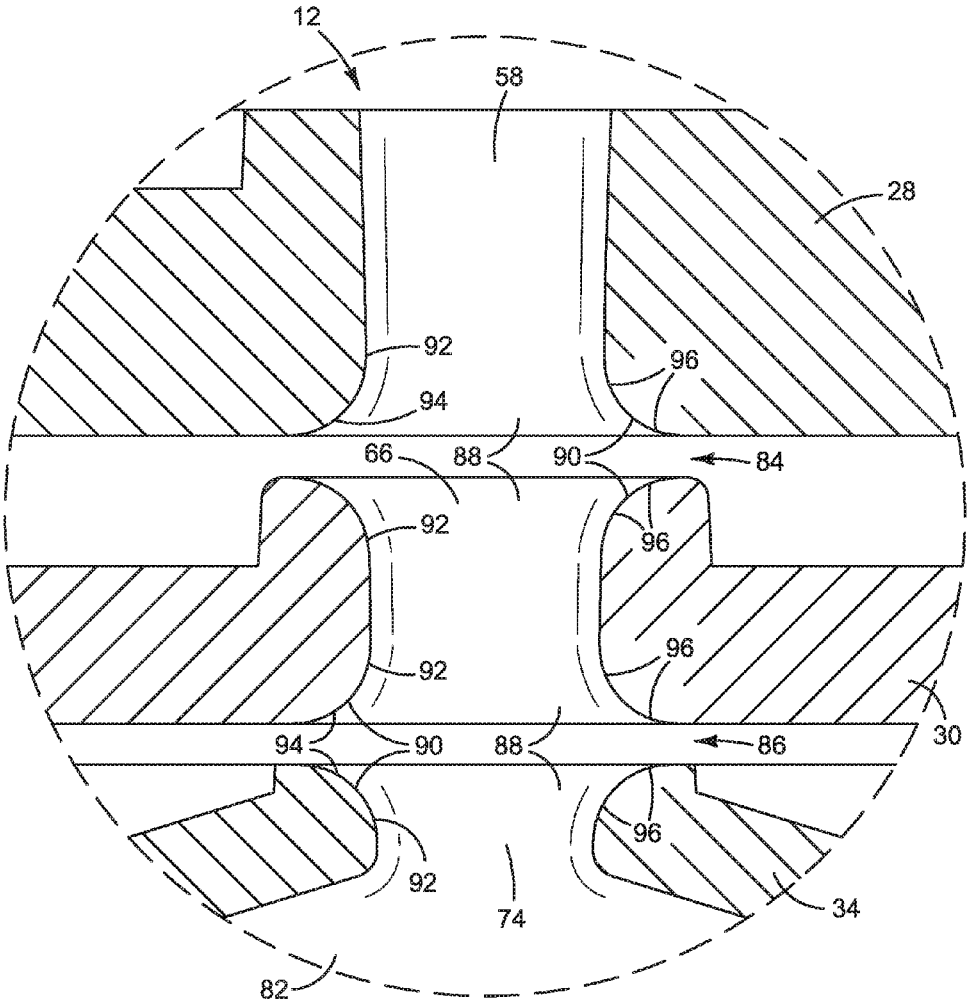
FIGS. 7-10 are close-up views of the adhesive joints in the flow structure of FIGS. 3-6.

FIGS. 5 and 6 are section views of flow structure 12 taken along the line 5, 6-5, 6 in FIG. 4. For clarity, the adhesive is omitted from FIG. 6. FIGS. 7-10 are close-up views of the adhesive joints in the example of flow structure 12 shown in FIGS. 5 and 6. FIG. 7 shows the assembled parts without adhesive. Referring to FIGS. 5-10, manifold 28 is joined to base 30 around each conduit 52-58 at a joint 84. Base 30 is joined to each feed plenum 32, 34 around each conduit 60-66 at a joint 86. Only one manifold/base joint 84 (at manifold conduit 58) and base/feed plenum joint 86 (at feed plenum conduit 66) are shown in FIGS. 5-10. It is expected that joints 84 and 86 will usually have the same configuration at each of the conduits 52-58 and 68-74, respectively. Thus, in this example of flow structure 12, the joint structure shown in FIGS. 5-10 is the same for all conduits 52-58 and 68-74.

Figure 8:
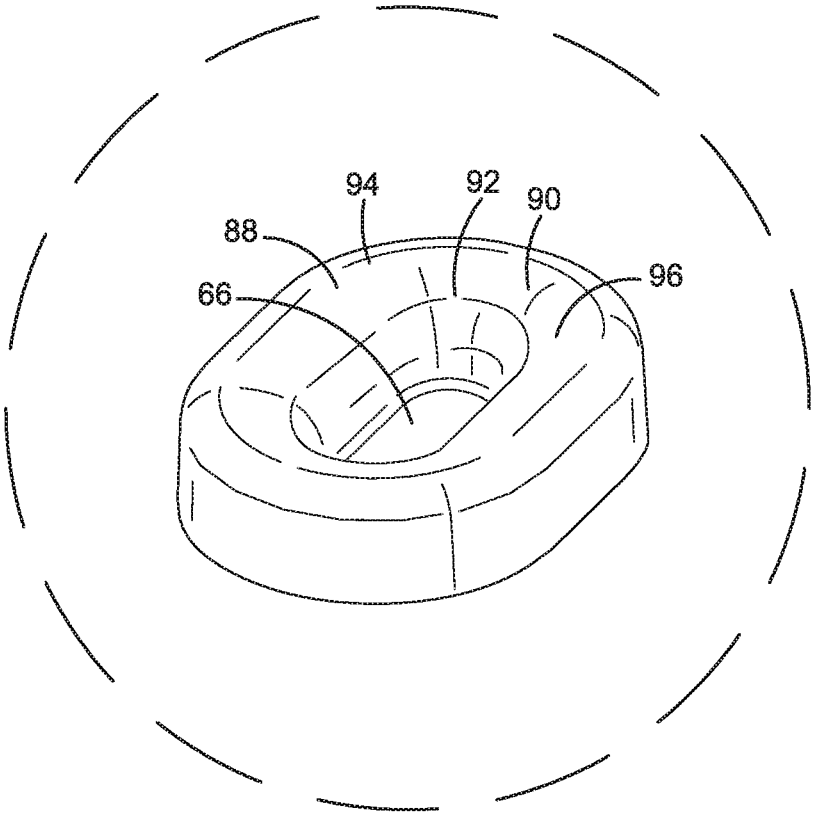

As best seen in FIGS. 7 and 8, the opening 88 to each flow conduit 58, 66, 74 transitions along a curve 90 from a smaller interior part 92 to a larger exterior part 94 that forms the inner part of the bonding surface 96. In the example shown, each curve 90 is symmetrical to the opposite curve 90 across joints 84, 86 so that adhesive wets each bonding surface 96 equally during assembly, and each curve 90 is substantially free of edges, voids or other discontinuities that might impede the flow of adhesive or trap air in the flow of adhesive. Also, in the example shown, bonding surface 96 at the perimeter of each opening 88 is curvilinear (oval or round) and transition curve 90 is constant around the perimeter of opening 88. Although different shapes may be used, the geometry of the joint should cause all regions of the adhesive bead to flow the same amount when it is compressed between the parts during assembly. Adhesive flow fronts converge at corners, increasing the risk of trapping air. Thus, while it might be suitable in some flow applications to utilize a rectilinear bonding surface 96 and/or a non-constant curve 90, it is expected that bonding surface 96 will usually be curvilinear with a constant transition curve 90.

Figure 9:
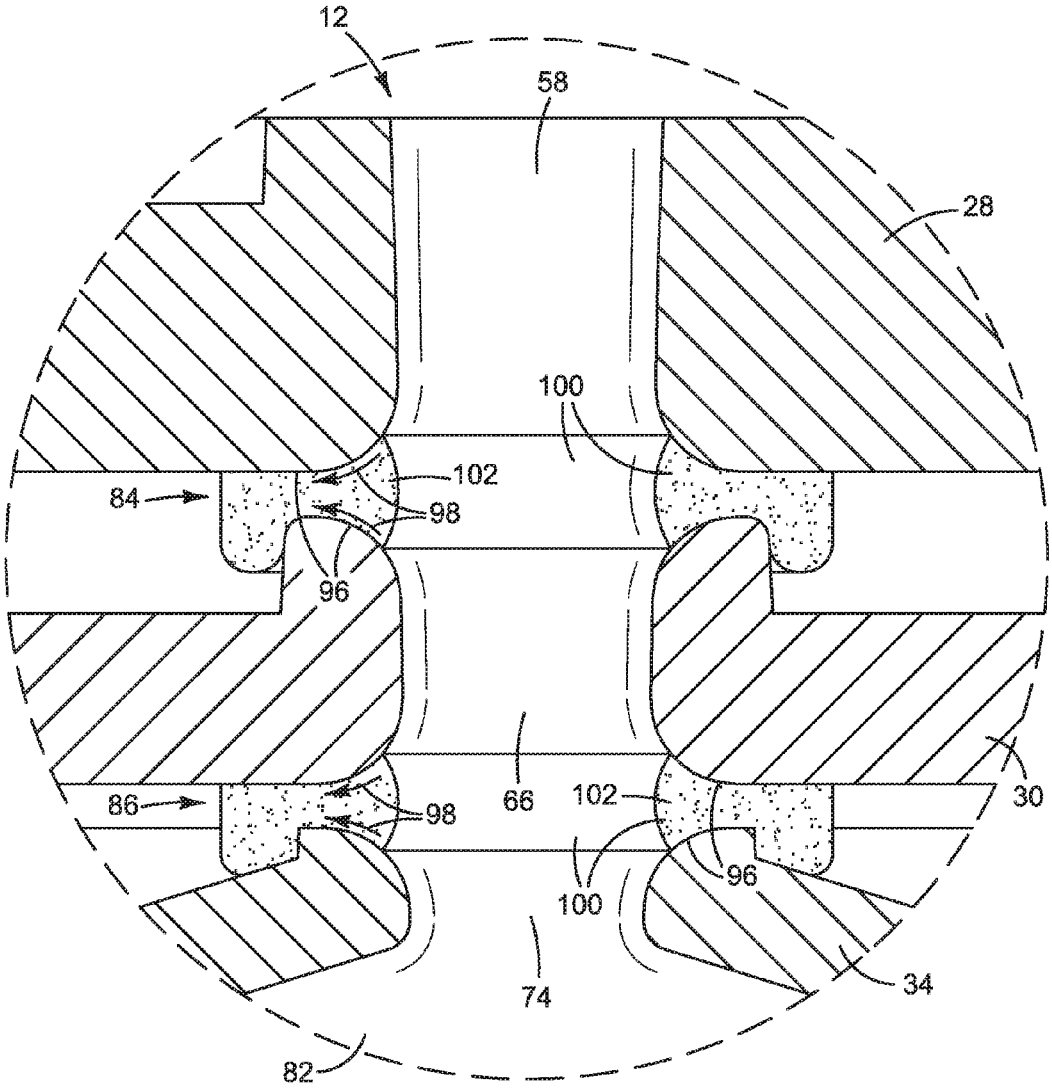
Figure 10:
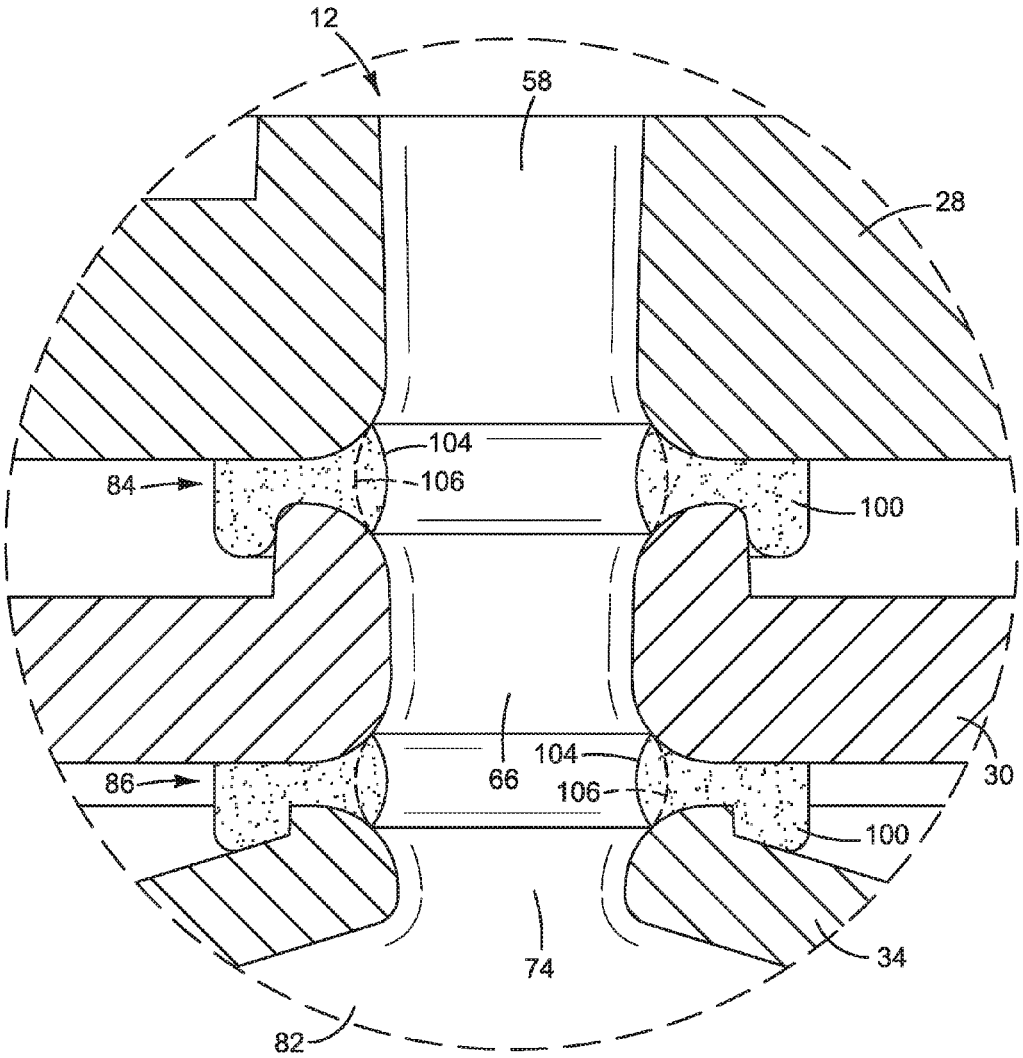

Referring to FIGS. 9 and 10, the curved bonding surfaces 96 surrounding each conduit opening 88 (FIG. 7) help create a capillary force along the bonding surface urging adhesive away from opening 88 and thus out of conduits 58, 66, 74, as indicated by arrows 98 in FIG. 9. The presence of these capillary forces allows dispensing adhesive closer to openings 88 (FIG. 7), thus minimizing the lateral flow of adhesive needed to make a robust bond and, accordingly, lowering the risk of trapping air in the joint but without increasing the risk of obstructing conduits 58, 66, 74. Curved bonding surfaces 96 also reduce the area of easily wetted straight parallel bonding surfaces and help cause the formation of a relatively thick ring 102 of adhesive 100 that serves as a reservoir of later gelling adhesive.

One mechanism that creates air defects in the adhesive joint is entraining and trapping air in the flow of adhesive as the joint is assembled. Testing indicates that air can be entrained when adhesive is forced past a discontinuity in the surfaces of the joint or when air is trapped between two or more converging adhesive flow fronts. The risk of both scenarios increases with increases in the lateral flow of the adhesive. Curved bonding surfaces 96 are substantially free of corners, edges, voids or other discontinuities that might impede the outward flow of adhesive and trap air along surfaces 96. Also, in the example shown, the curvature and arc length of bonding surfaces 96 are constant all around openings 88 and symmetrical on each part across the joint. This constancy around the openings 88 and symmetry across the joint helps all regions of the adhesive bead flow laterally equal distances as the parts are assembled to avoid converging flow fronts and trapping air.

A second mechanism that causes air defects in the adhesive joint is movement of the parts away from one another as the adhesive cures. When the bonding surfaces move away from one another, the adhesive will resist de-wetting the bonding surfaces and will instead move with those surfaces, causing the normally bulged out convex profile 104 to retract toward a concave profile 106 shown in FIG. 10. Eventually, with continued part movement, voids will open in the strained adhesive, allowing air to enter the joint. The outward flow induced by curved bonding surfaces 96 allows the adhesive to be placed closer to conduits 58, 66, 74, requiring less adhesive flow at assembly and leaving the adhesive in a lower stress level. Accordingly, each joint will tolerate more movement without allowing air to enter the bulk adhesive. Also, the opposed curved bonding surfaces provides a comparatively large reservoir 102 (FIG. 9) of later gelling adhesive that can preferentially flow back into the joint to relieve stress caused by part movement and thereby further limit the incidence of trapped air.

A third mechanism that causes air defects in the adhesive joint is over compression of the joint during assembly, which can occur in automated assembly processes tuned to accommodate the range of variation in part and fixture dimensions. Over compression causes the adhesive to flow and wet additional surface areas along the inner and outer edges of the joint. When the joint relaxes the adhesive resists de-wetting these areas, similar to when the parts move during adhesive cure as described above. Opposed curved bonding surfaces 96 at the inside of joints 84, 86 provide a non-linear relationship between joint fill volume and inward displacement of adhesive. It has been discovered that, rather than the constant increase in inward displacement for every unit increase in adhesive fill volume seen in straight, parallel bonding surfaces, the inward displacement of the adhesive actually decreases as the volume of the adhesive in the joint increases. The unique shape of the opposed curved bonding surfaces creates a non-linear relationship between joint fill volume and the inward displacement of the adhesive. During over compression a larger volume of adhesive can bulge (convex profile 104 in FIG. 10) into the inner part of the joint before the adhesive is forced to flow and wet-out additional surface areas along both edges. During relaxation, adhesive that was displaced into the bulge can flow back into the joint (concave profile 106 in FIG. 10). Since less additional surface area is wetted during over compression, the adhesive will be at a lower stress level than a joint with straight surfaces, further reducing the risk of trapping air at the edges of the joint.

Finally, the inward displacement of adhesive actually decreases as the volume of the adhesive in the joint increases. This means that the reservoir 102 of later gelling adhesive can be used effectively to relieve stress caused by part movement, as described above, without occluding ink flow conduits 58, 66, 74.

Although the shape and size of transition curve 90 may vary depending on the particular flow structure, it is expected that a radius 90 of at least 0.5 mm will be suitable for the flow structure in an inkjet printhead assembly such as that shown in FIGS. 1 and 2. Also, it is expected that as large a radius or other curve 90 as possible will be desirable for most flow structures, to increase the capacity of the adhesive reservoir 102 to accommodate tolerance stacks in the assembled parts. Thus, the size of curve 90 should only be limited by molding concerns and the ability to cure the adhesive. The surfaces of the joint where the adhesive is likely to flow should be substantially free of raised edges, voids, or other discontinuities that can interrupt adhesive flow fronts or otherwise trap air during adhesive flow. For example, testing indicates that molding insert flash rings as small as 0.08 mm can trap air in the joint.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A multi-part fluid flow structure, comprising:

a first part including a first conduit, an opening from the first conduit, and a curved first bonding surface surrounding the opening from the first conduit;

a second part including a second conduit, an opening into the second conduit aligned with the opening from the first conduit, an opening from the second conduit, a curved second bonding surface surrounding the opening into the second conduit opposite and symmetrical to the first bonding surface, and a curved third bonding surface surrounding the opening from the second conduit;

a third part including a third conduit, an opening into the third conduit aligned with the opening from the second conduit, and a curved fourth bonding surface surrounding the opening into the third conduit opposite and symmetrical to the third bonding surface;

adhesive along the first and second bonding surfaces joining the first and second parts; and adhesive along the third and fourth bonding surfaces joining the second and third parts.

2. The flow structure of claim 1, where:

the first conduit comprises multiple first conduits, an upstream side of the first part includes multiple channels each to carry fluid to an opening into each of the first conduits, and the curved first bonding surface comprises multiple curved first bonding surfaces each surrounding the opening from one of the first conduits;

the second conduit comprises multiple second conduits, the curved second bonding surface comprises multiple curved second bonding surfaces each surrounding the opening into one of the second conduits, and the curved third bonding surface comprises multiple curved third bonding surfaces each surrounding the opening from one of the second conduits; and the third conduit comprises multiple third conduits, the curved fourth bonding surface comprises multiple curved fourth bonding surfaces each surrounding the opening into one of the third conduits, and a downstream side of the third part includes multiple slots each to carry fluid away from an opening from each of the third conduits.

3. The flow structure of claim 2, where each of the bonding surfaces transitions along a constant curve from a smaller interior part to a larger exterior part.

4. The flow structure of claim 3, where each of the bonding surfaces transitions along a radius of at least 0.5 mm from the smaller interior part to the larger exterior part.

5. A printhead assembly, comprising:

a printhead; and a multi-part flow structure with multiple flow passages to carry liquid to the printhead, the multi-part flow structure including a first part sandwiched between a second part and a third part, the parts joined together with adhesive along bonding surfaces surrounding the flow passages, where each of the bonding surfaces on one part is symmetrical to and diverges from a corresponding one of the bonding surfaces on another part.

6. The printhead assembly of claim 5, where each bonding surface is a curved bonding surface.

7. The printhead assembly of claim 6, where the curve of each bonding surface is constant.

8. The printhead assembly of claim 7, where the printhead is mounted to the first part.

9. The printhead assembly of claim 8, where liquid is to flow through the multi-part structure from the second part to the first part to the third part to the printhead.

10. A printhead assembly, comprising:

a printhead; and a multi-part flow structure with multiple conduits to carry liquid to the printhead, the multi-part flow structure including a first part mounting the printhead and sandwiched between a second part and a third part, the parts joined together with adhesive along curved bonding surfaces each surrounding an opening into or out of one of the conduits.

11. The printhead assembly of claim 10, where each of the curved bonding surfaces on one part is aligned with and symmetrical to a corresponding one of the curved bonding surfaces on another part.

12. The printhead assembly of claim 11, where:

the first part includes an upstream side with multiple channels each to carry a liquid downstream to a corresponding conduit through the first part;

the second part includes multiple conduits each to carry a liquid through the second part from a corresponding one of the conduits in the first part; and the third part includes multiple conduits each to carry liquid from a corresponding one of the conduits in the second part toward the printhead.

13. The printhead assembly of claim 12, where the third part includes multiple expanding slots each to carry a liquid downstream to the printhead from a corresponding one of the conduits in the third part.

* * * * *